United States Patent [19]

Willis

[11] Patent Number: 4,905,372

[45] Date of Patent: Mar. 6, 1990

[54] RAZOR HANDLE EXTENSION

[76] Inventor: Warren W. Willis, 16211 Mt. Craig Cir., Fountain Valley, Calif. 92708

[21] Appl. No.: 173,556

[22] Filed: Mar. 15, 1988

[51] Int. Cl.[4] ..... B26B 21/14

[52] U.S. Cl. ..... 30/85; 30/90

[58] Field of Search ..... 30/85, 86, 87, 88, 89

[56] References Cited

U.S. PATENT DOCUMENTS 2,279,324 4/1942 Pallen et al. ..... 30/85 X

FOREIGN PATENT DOCUMENTS 609618 5/1926 France ..... 30/85

1802 1/1905 United Kingdom ..... 30/85

*Primary Examiner*—Frank T. Yost

*Assistant Examiner*—Willmon Fridie, Jr.

*Attorney, Agent, or Firm*—Morland C. Fischer

[57] ABSTRACT

A razor handle extension which is adapted to be detachably connected to the handle of a disposable razor to effectively increase the length of the handle and thereby permit a female user to more easily and safely shave her legs from an erect position. The razor handle extension has a gripping area at one end thereof. The opposite end includes a hollow receptacle for receiving and retaining the razor handle. A locking ring fits over the receptacle end of the razor handle extension for holding the razor handle therewithin.

17 Claims, 2 Drawing Sheets

RAZOR HANDLE EXTENSION

BACKGROUND OF THE INVENTION

1. Field of the Invention

This invention relates to a razor handle extension which may be detachably connected to the handle of a disposable razor to increase the effective length of the handle and thereby permit a female user to more easily and safety shave her legs from an erect position.

2. Prior Art

Women are known to shave their legs while taking a shower or bath. Sometimes, a woman is standing on a wet or slippery surface. In either event, because of the relatively short length of the razor handle, the woman is typically required to bend over or kneel while shaving her legs. Such a bent position is usually uncomfortable if maintained for a long enough time. Moreover, due to age and/or a degenerative condition, some women experience difficulty in bending or kneeling, whereby the shaving process is made that much more difficult. What is more, bending or kneeling on a slippery or wet surface or standing on one leg in a bathtub while raising the other leg to be shaved may provide an unsafe condition and a possibility that the woman may slip and sustain an injury. Nothing is known which will overcome the aforementioned problems while permitting a woman to controllably and reliably shave her legs.

SUMMARY OF THE INVENTION

In general terms, a razor handle extension is disclosed that is to be detachably connected to the handle of a disposable razor, or the like, to effectively increase the length of the handle. The razor handle extension comprises an elongated body having a gripping area at one end and a hollow head portion at the opposite end. The head portion of the razor handle extension has a plurality of axially extending slots formed therethrough for creating a corresponding plurality of flexible retaining arms between said slots. The head portion tapers outwardly from the body and has a series of retaining flanges which extend circumferencially and in spaced alignment with one another around the retaining arms. A locking ring is provided to extend around the head portion so as to be seated in the space between a pair of adjacent retaining flanges.

In operation, the handle of a disposable razor is inserted into the hollow interior of the head portion of the razor handle extension. The locking ring is then moved up and over the tapered head portion so as to be seated between a pair of retaining flanges. The movement of the locking ring up the tapered head portion causes the flexible retaining arms to be rotated into engagement with and thereby releasably retain the handle of the razor at the interior of the head portion. Accordingly, a detachable razor handle extension is provided by which a female user may more easily and safely shave her legs from an erect position, while avoiding the discomfort and possibility of slipping that have heretofore been associated with shaving while bent over.

DESCRIPTION OF THE PREFERRED EMBODIMENTS

Figure 1:
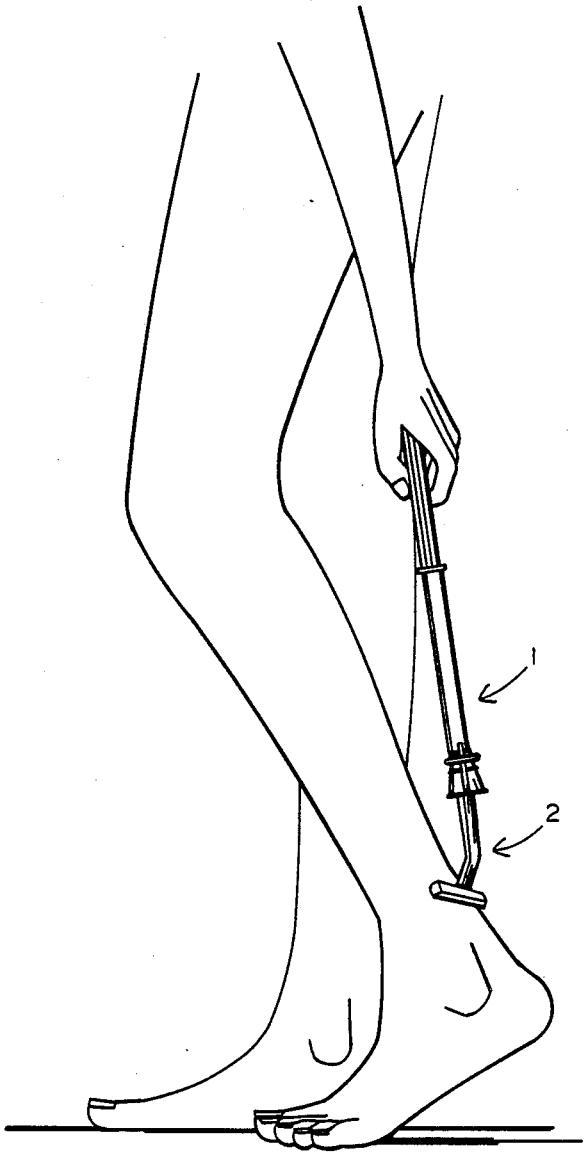
FIG. 1 illustrates a woman using the razor handle extension of the present invention together with a razor to shave her legs in an erect position.

The razor handle extension 1 of the present invention is best described while referring to the drawings, where FIG. 1 shows a woman using the extension with a disposable razor for shaving her legs from an erect position. That is, and as will be described in greater detail, the handle of a disposable razor 2 may be removably retained by the razor handle extension 1. In this manner, the length of the razor handle is effectively increased so that a woman user may more easily and safely shave her legs while in a generally erect position, whereby to avoid the discomfort of having to bend over and minimize the risk of slipping as a result of shaving on a slippery or wet surface. Accordingly, the razor handle extension 1 of the present invention is particularly useful while the user is bathing or showering or at any time that is devoted to grooming the legs.

Figure 3:
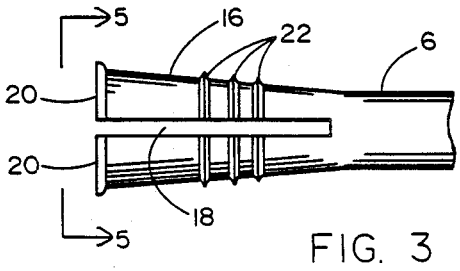
FIG. 3 is an enlarged detail of the head portion of the razor handle extension of FIG. 2.
Figure 4:
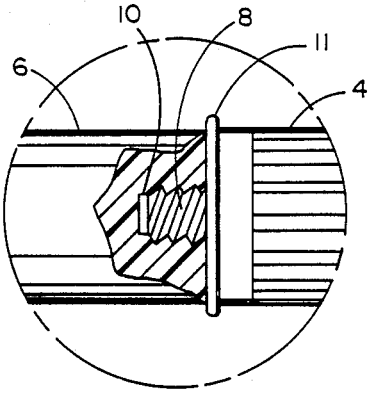
FIG. 4 is an enlarged detail taken from FIG. 2 to illustrate the detachable assembly of the razor handle extension.
Figure 5:
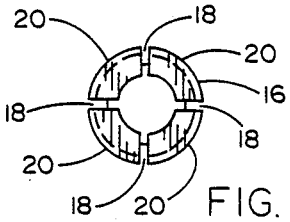
FIG. 5 is an end view of the razor handle extension taken along lines 5—5 of FIG. 3.

The details of the razor handle extension 1 are now disclosed while referring concurrently to FIGS. 2–5 of the drawings. Razor handle extension 1 includes a handle portion 4 which is detachably connected to a razor gripping portion 6. The handle and gripping portions 4 and 6 are preferably fabricated from a non-breakable, rust resistant material such as plastic, or the like. As is best shown in FIG. 4, the handle portion 4 has a screw threaded male connector 8 projecting outwardly from one end thereof. The gripping portion 6 has a complementary screw threaded female receptacle 10 formed in an opposing end thereof. The handle portion 4 is connected to the gripping portion 6 by rotating the male connector 8 into receipt by the female receptacle 10. A lip 11 extends around the periphery of handle portion 4 and is located at the intersection of handle portion 4 and gripping portion 6. The function of peripheral lip 11 will soon be described.

The male connector 8 is rotated out of engagement of the female receptacle 10 to detach handle portion 4 from gripping portion 6 in order to form a compact disassembly that is suitable to be transported and stored, such as, for example, in a travel kit or in a drawer of a bathroom. Of course, the razor handle extension could also be formed with the male connector 8 extending from the gripping portion 6 and the female receptacle 10 formed in the handle portion 4.

Figure 2:
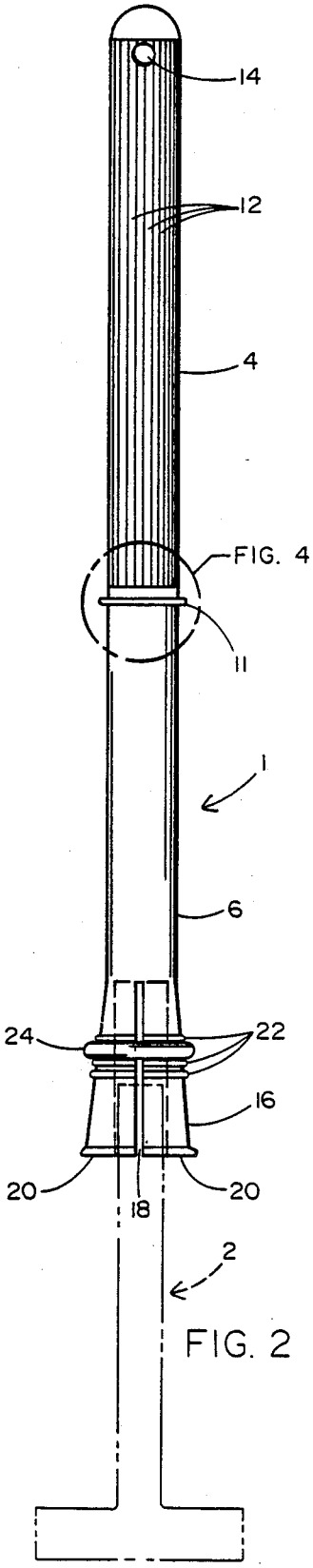
FIG. 2 is a front plan view of the razor handle extension.

As is best shown in the assembled configuration of FIG. 2, the handle portion 4 includes an elongated, generally cylindrical shape having a plurality of parallel aligned, axially extending ridges 12 by which to form an anti-slip surface and thereby enable the user to more reliably grasp the razor 2 in a wet and/or soapy environment. A hole 14 is formed through handle portion 4 so that a cord (not shown), or the like may be received therethrough in order that razor handle extension 1 may be hung at a convenient location.

Figure 6:
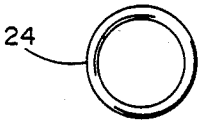
FIG. 6 is a front view of a locking ring of the razor handle extension of FIG. 2.
Figure 7:
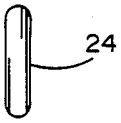
FIG. 7 is a side view of the locking ring.

As is best shown in FIGS. 2–4, the gripping portion 6 includes a hollow, conical head 16 which is coextensively connected to and tapered outwardly (e.g. at an angle of 5 to 7 degrees) from a generally cylindrical body. The head 16 includes a series (e.g. four) of evenly spaced, axially extending slots 18. The slots 18 extend through head 16 to create flexible retaining arms 20 which are characterized by a spring-like memory. A series of coextensive, evenly spaced retaining flanges 22 project outwardly from the head 16 of gripping portion 6 so as to encircle the retaining arms 20. The distance between the retaining flanges 22 is selected so that a pair of adjacent flanges 22 may accommodate a locking ring 24 (best illustrated in FIGS. 6 and 7) in the space therebetween. Locking ring 24 is formed from a resilient material and is adapted to slide axially along gripping portion 6 between the peripheral lip 11 around handle portion 4 and the tapered head 16.

In operation, the locking ring 24 is located around the gripping portion 6 of razor handle extension 1 before the interconnection of the gripping and handle portions 4 and 6 to one another. The handle portion 4 is detachably connected to gripping portion 6 by rotating the screw threaded male connector 8 into releasable engagement with the screw threaded receptacle 10 in the manner previously described while referring to FIG. 4. The handle of a disposable razor (shown in phantom and designated by the reference numeral 2 in FIG. 2) is then inserted into the hollow interior of the tapered head 16 of gripping portion 6 between the flexible arms 20 thereof. With a razor 2 extending outwardly from the gripping portion 6, the locking ring 24 is moved up and over the tapered head 16 and into the space between a pair of the pertaining flanges 22.

More particularly, the movement of locking ring 24 up tapered head 16 causes the flexible retaining arms 20 to rotate inwardly and into engagement with the handle of razor 2. The locking ring 24 is seated in the space between a pair of adjacent retaining flanges 22 so as to firmly anchor the handle of razor 2 at the hollow interior of the head 6 and between the arms 20. By providing a plurality of retaining flanges 22 along tapered head 16, the locking ring 24 may be seated between the particular pair of flanges which will cause the retaining arms 20 to rotate toward, engage, and, thereby, anchor razor 2 within the hollow head 16 of razor gripping portion 6. Moreover, razor handles of varying circumferences may be advantageously retained within the hollow head 6 by locating the locking ring 24 in the space between an appropriate pair of retaining flanges 2.

Accordingly, the detachable connection of handle portion 4 to gripping portion 6 creates the elongated razor handle extension 1 of the present invention, whereby to facilitate the process by which a user shaves her legs, while eliminating the discomfort and possible safety hazard that are commonly associated with shaving from a bent or kneeling position. After use, the razor may be removed from the gripping portion 6 for replacement or disposal by merely unseating the locking ring 24 from the space between a pair of retaining flanges 22. The flexible retaining arms 20 will automatically rotate back to their original position, whereby to release the handle of razor 2 from the hollow interior of tapered head 16. The locking ring 24 is then free to move down the tapered head 16 and slide axially along the body of gripping portion 6. However, the peripheral lip 11 which extends from handle portion 4 will block the inadvertent removal and possible loss of locking ring 24. Thus, the locking ring 24 may only be removed after the razor handle extension 1 has been disassembled, in the manner previously described.

Figure 8:
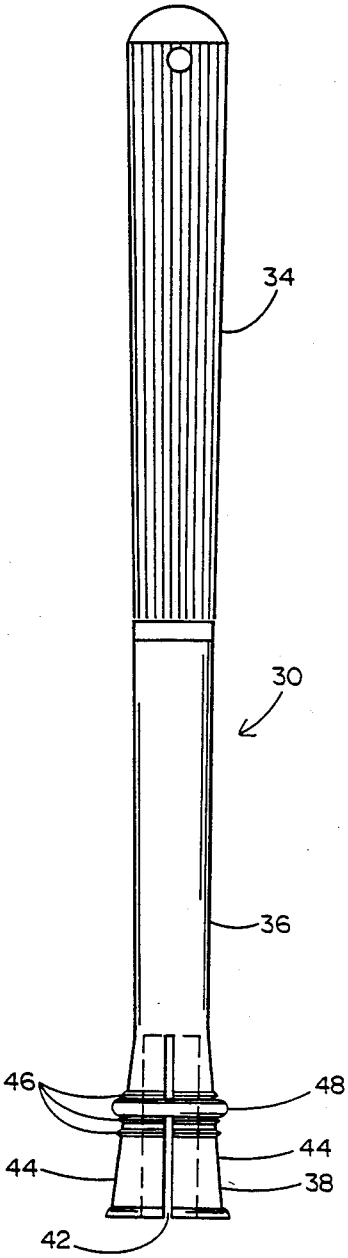
FIG. 8 is a front, plan view of a razor handle extension according to an alternate embodiment of the invention.

FIG. 8 shows an alternate embodiment of the razor handle extension 1 of FIGS. 1–7. More particularly, the razor handle extension 30 of FIG. 8 includes a handle portion 44 which is integrally connected to a razor gripping portion 36. Thus, unlike the razor handle extension 1, the razor handle extension 30 is formed as a single piece (e.g. of molded plastic). Like the razor handle extension 1, razor gripping portion 36 of razor handle extension 30 includes a conical head 38 which is coextensively connected to and tapered outwardly from a generally cylindrical body. A plurality of evenly spaced, axially aligned slots 42 are formed through the head 38 so that a corresponding number of flexible retaining arms 44 are formed therebetween. A series of spaced retaining flanges 46 extend from the tapered head 38 so that a locking ring 48 may be seated in the space between an adjacent pair of flanges 46.

Unlike the handle portion 4 of razor handle extension 1, the handle portion 34 of razor handle extension 30 is tapered outwardly from the interception of handle portion 34 with gripping portion 36. In the embodiment of FIG. 8, the peripheral lip (designated 11 in FIGS. 2 and 4) is eliminated. Thus, the locking ring 48 may slide axially along the cylindrical body of gripping portion 36 between the tapered head 38 and the tapered handle portion 34. That is to say, the locking ring 48 extends around the head 38 of gripping portion 36 between a pair of adjacent retaining flanges 46 when it is desirable to releasably retain the handle of a disposable razor (not shown) between flexible retaining arms 44. The tapered handle portion 34 prevents the inadvertent removal and possible loss of the locking ring 48 when the ring is removed from the tapered head 38 in order to release the razor from the retaining arms 44. Therefore, the travel of locking ring 48 is limited to axial movement along the gripping portion 36.

The operation of the razor handle extension 30 is substantially identical to the operation of the razor handle extension 1, as previously disclosed. Accordingly, for purposes of brevity, the operation of razor handle extension 30 will not be disclosed herein.

It will be apparent that while a preferred embodiment of the invention has been shown and described, various modifications and changes may be made without departing from the true spirit and scope of the invention. For example, although the razor handle extensions 1 and 30 have been described as having particular application to releasably retaining a razor handle, it is to be understood that the present invention is also applicable for engaging and effectively extending the length of handle of other articles, whereby to enable the user to more easily reach an area that would be difficult or inconvenient to otherwise access.

Having thus set forth the preferred embodiments of the present invention what is claimed is:

I claim:

1. A razor handle extension having a handle end at which to be grasped and a gripping end at which to engage and releasably retain the handle of a razor so that the movement of said razor can be controlled from the handle end of said razor handle extension, said gripping end including a hollow head in which to receive the razor handle, and locking means including a locking ring which is slidable axially and reciprocally between said handle end and the hollow head of said gripping end so as to surround said hollow head and thereby releasably retain the razor handle therewithin.

2. The razor handle extension recited in claim 1, wherein the hollow head of said gripping end has a plurality of axially extending slots formed therethrough for creating a corresponding plurality of retaining arms between said slots, said razor handle being received at the hollow interior of said head and between the retaining arms thereof.

3. The razor handle extension recited in claim 2, wherein the retaining arms of said head are rotated into contact with said razor handle when said locking ring surrounds said head to thereby anchor said razor handle at the hollow interior of said head.

4. The razor handle extension recited in claim 1, including a lip extending around the periphery of said handle end to block the removal of said locking ring by way of said handle end.

5. The razor handle extension recited in claim 1, wherein said handle end is tapered to block the removal of said locking ring by way of said handle end.

6. The razor handle extension recited in claim 1, wherein the head of said gripping end is tapered in an outwardly flared direction.

7. The razor handle extension recited in claim 6, wherein the tapered head of said gripping end includes at least a pair of retaining flanges extending in spaced alignment with one another around the periphery of said head, said locking ring being removably seated within the space between said flanges for rotating said retaining arms and holding said arms in contact with said razor handle at the hollow interior of said head.

8. The razor handle extension recited in claim 1, wherein said handle end and said gripping end are detachably connected to one another.

9. The razor handle extension recited in claim 8, wherein said handle end has a male connector extending therefrom and said gripping end has a female receptacle formed therein, said male connector received within said female receptacle for detachably connecting said handle and gripping ends to one another.

10. The razor handle extension recited in claim 1, wherein said locking means is a locking ring which slides over and surrounds the head of said gripping end to cause said razor handle to be retained within the hollow interior of said head.

11. The razor handle extension recited in claim 1, wherein said gripping end further includes at least two retaining flanges which extend in spaced alignment with one another around said head, said locking ring being moved into the space between said retaining flanges to prevent an axial displacement of said ring and cause said razor handle to be anchored within the hollow interior of said head.

12. The razor handle extension recited in claim 1, wherein said locking ring is slidable axially and reciprocally between said gripping end and said handle end, said locking ring surrounding the head of said gripping end to cause said razor handle to be retained within the hollow interior of said head, or said locking ring being removed from said head and relocated towards said handle end to release said razor handle from said head.

13. The razor handle extension recited in claim 1, wherein the head of said gripping end, said handle end, and said locking ring are concentrically aligned with one another.

14. A handle extension to be detachably connected to the handle of a razor to increase the effective length of said handle, said razor handle extension comprising an elongated body portion and a head portion having a hollow interior in which to receive said razor handle, said head portion having a plurality of axially extending slots formed therethrough for creating a corresponding plurality of flexible retaining arms between said slots, and a locking ring to be positioned around said retaining arms for rotating said arms into contact with said razor handle to thereby anchor said handle at the hollow interior of said portion, said locking ring being moved between said head portion and said body portion, said locking ring surrounding the retaining arms of said head portion to anchor the razor handle therewithin, or said locking ring being removed from said head portion and relocated to said body portion to release said razor handle from said head portion.

15. The handle extension recited in claim 14, wherein said head portion includes at least a pair of retaining flanges extending in spaced alignment with one another around said retaining arms, said locking ring being seated within the space between said flanges for holding said retaining arms in contact with said razor handle.

16. The handle extension recited in claim 14, wherein said head portion is tapered outwardly from said body portion.

17. The handle extension recited in claim 14, wherein said head portion, said body portion and said locking ring are concentrically aligned with one another.

* * * * *